US008132890B2

(12) United States Patent
Umeda

(10) Patent No.: US 8,132,890 B2
(45) Date of Patent: Mar. 13, 2012

(54) RECOVERY APPARATUS AND INKJET RECORDING APPARATUS

(75) Inventor: Takaichiro Umeda, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1062 days.

(21) Appl. No.: 11/588,686

(22) Filed: Oct. 26, 2006

(65) Prior Publication Data

US 2007/0097172 A1 May 3, 2007

(30) Foreign Application Priority Data

Oct. 31, 2005 (JP) ..... 2005-317049

(51) Int. Cl.
*B41J 2/165* (2006.01)

(52) U.S. Cl. ..... 347/31

(58) Field of Classification Search ..... None
See application file for complete search history.

(56) References Cited

U.S. PATENT DOCUMENTS

| | | | | |
|---|---|---|---|---|
| 4,543,589 | A * | 9/1985 | Terasawa | 347/31 |
| 5,717,444 | A * | 2/1998 | Sugimoto et al. | 347/29 |
| 6,017,109 | A * | 1/2000 | Saijo | 347/30 |
| 6,203,136 | B1 * | 3/2001 | Takahashi et al. | 347/32 |
| 6,910,757 | B2 * | 6/2005 | Kanamitsu et al. | 347/31 |
| 2005/0007412 | A1 * | 1/2005 | Nishikawa et al. | 347/33 |
| 2005/0046666 | A1 * | 3/2005 | Horio et al. | 347/31 |

FOREIGN PATENT DOCUMENTS

| | | |
|---|---|---|
| JP | 04-173343 | 6/1992 |
| JP | 7125257 | 5/1995 |
| JP | 9024617 | 1/1997 |
| JP | 10166613 | 6/1998 |
| JP | 2003-211706 | 7/2003 |
| JP | 2004-262138 | 9/2004 |
| JP | 2005041190 | 2/2005 |

* cited by examiner

*Primary Examiner* — Matthew Luu
*Assistant Examiner* — Alejandro Valencia
(74) *Attorney, Agent, or Firm* — Frommer Lawrence & Haug LLP

(57) ABSTRACT

A recovery apparatus including an absorber, a holder member and a waste liquid foam is provided. The absorber abuts at least one nozzle for discharging ink and absorbs the ink from the nozzle by a capillary force. The holder member includes an open recessed portion and a communication port communicating an inside of the recessed portion with an outside of the recessed portion. The recessed portion houses the absorber. The waste liquid foam is disposed outside the holder member and contacts the absorber through the communication port of the holder member. The waste liquid foam has a capillary force greater than the capillary force of the absorber.

15 Claims, 7 Drawing Sheets

RECOVERY APPARATUS AND INKJET RECORDING APPARATUS

CROSS-REFERENCE TO RELATED APPLICATION

This application claims the benefit of Japanese Patent Application No. 2005-317049 filed Oct. 31, 2005 in the Japanese Patent Office, the disclosure of which is incorporated herein by reference.

BACKGROUND

The present invention relates to an inkjet recording apparatus provided with a recovery apparatus that absorbs waste ink from nozzles of a recording head.

In an example of conventional inkjet recording apparatuses, a recovery process of discharging ink with an increased viscosity due to evaporation of water, and other from nozzles, and of supplying fresh ink in the nozzles is performed. A typical recovery process includes covering the nozzles with a cap, and suctioning the ink in the nozzles with a pump, or applying pressure to the ink with the pump to cause the ink to be discharged from the nozzle into the cap. In this case, an amount of ink consumption is likely to be more than necessary since the ink in all the nozzles is discharged in the recovery process. Especially in a case of a full-line type recording head, an amount of ink consumption tends to be larger.

There is a known inkjet recording apparatus which includes a cover member provided with an absorber having a capillary force greater than a capillary force in a nozzle of a recording head. In a recovery process, the cover member is moved to the nozzle to cause the absorber to contact the nozzle and thereby absorb ink in the nozzle.

SUMMARY

The above described inkjet recording apparatus provided with the absorber also includes a container or the like outside the cover member so as to collect the ink absorbed by the absorber. This, however, poses the following problem. Specifically, even when an attempt is made to discharge the ink from the cover member through a tube or the like, the ink does not flow out into the container or the like due to a capillary force of the absorber and other reasons. Accordingly, the inkjet recording apparatus provided with the absorber requires a pump for suctioning the ink from the absorber. This results in a larger and more complicated configuration of the inkjet recording apparatus.

One aspect of the present invention may provide an apparatus capable of collecting ink by a simple structure.

In the one aspect of the present invention, there is provided a recovery apparatus including an absorber, a holder member and a waste liquid foam. The absorber abuts at least one nozzle for discharging ink and absorbs the ink from the nozzle by a capillary force. The holder member includes an open recessed portion and a communication port communicating an inside of the recessed portion with an outside of the recessed portion. The recessed portion houses the absorber. The waste liquid foam is disposed outside the holder member and contacts the absorber through the communication port of the holder member. The waste liquid foam has a capillary force greater than the capillary force of the absorber.

According to the recovery apparatus of the present invention, in which the absorber and the waste liquid foam contact each other, waste ink may be collected in the waste liquid foam without using a pump. Thus, a structure of the inkjet recording apparatus may be simplified and downsizing of the inkjet recording apparatus may be achieved.

BRIEF DESCRIPTION OF THE DRAWINGS

Preferred embodiments of the present invention will be described hereinafter with reference to the drawings, in which.

DETAILED DESCRIPTION OF THE PREFERRED EMBODIMENTS

First Embodiment

Figure 1:
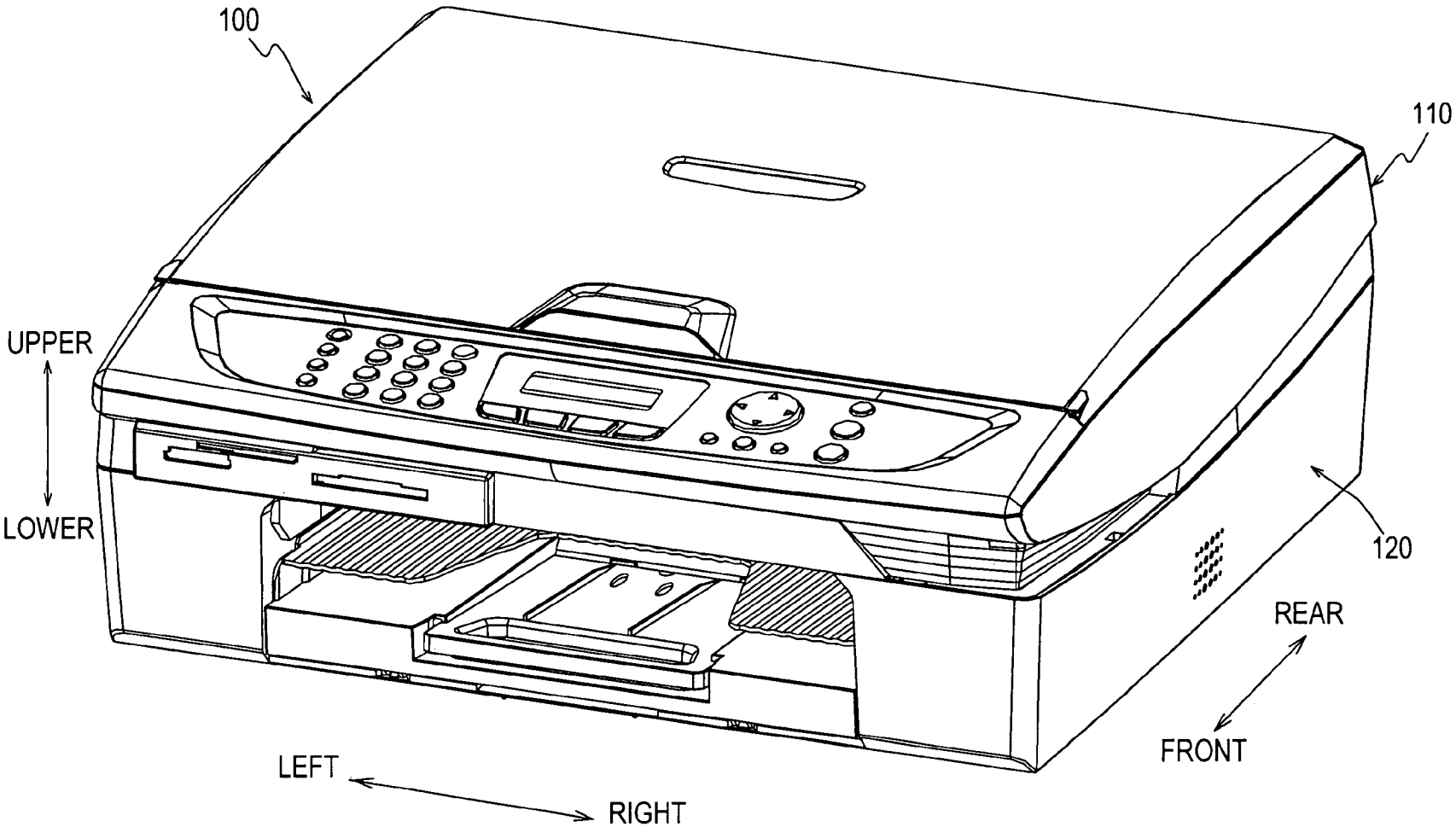
FIG. 1 is a front perspective view of a multi-function device.

As shown in FIG. 1, a multi-function device (MFD) 100 integrally includes an image scanner 110 disposed in an upper portion of the MFD 100 and an inkjet recording apparatus 120 disposed in a lower portion of the MFD 100.

Figure 2:
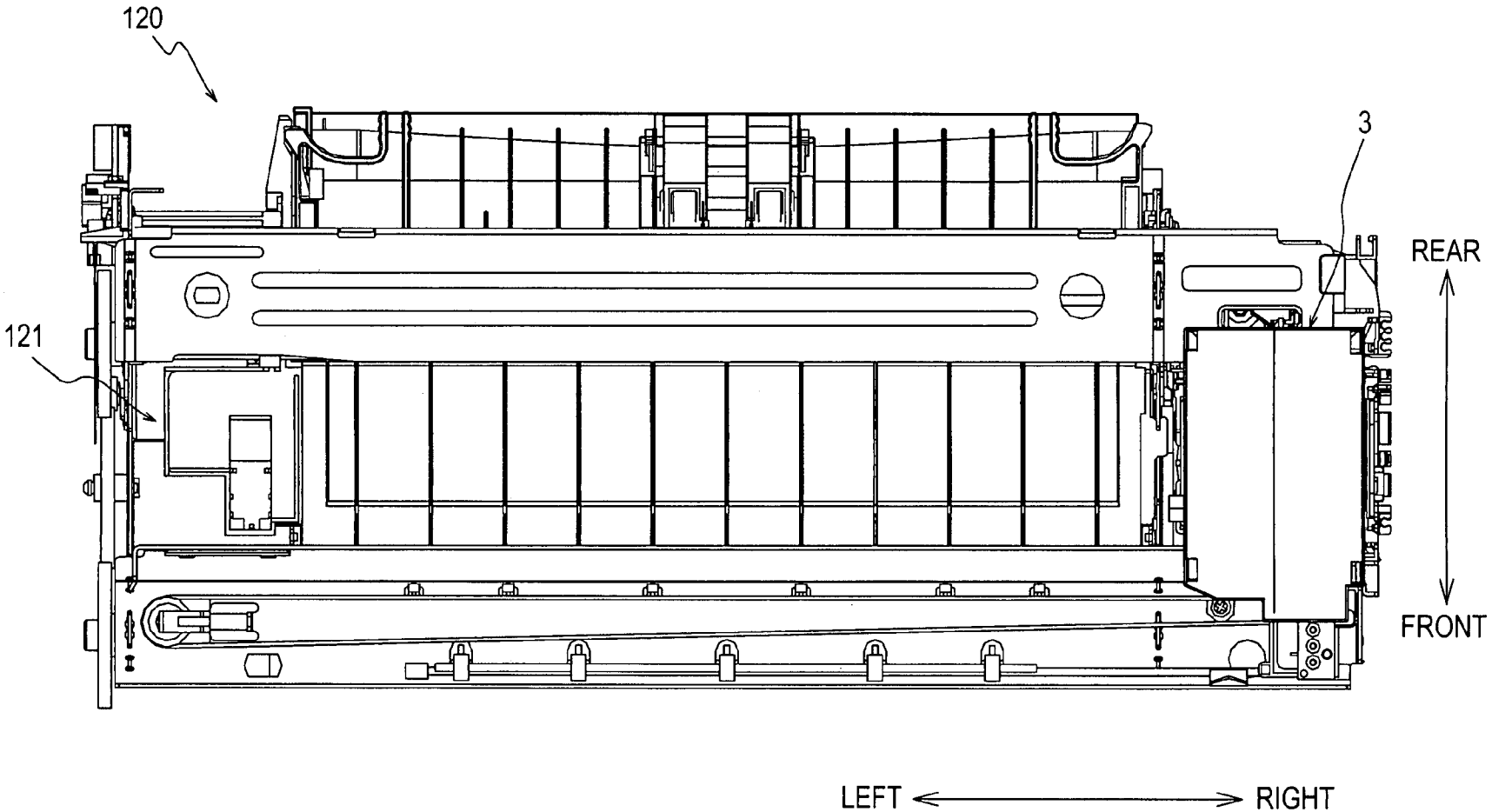
FIG. 2 is a top plan view of an inside of an inkjet recording apparatus.

As shown in FIG. 2, the inkjet recording apparatus 120 includes an upwardly open box-like frame 121. Inside the frame 121, a carriage 3 is provided in a bridging manner so as to be reciprocable in a right-and-left direction. A later-described recording head (see FIG. 3) is mounted on the carriage 3. A later-described recovery apparatus (see FIG. 3) is provided at a right end portion of a movement area of the carriage 3 inside the frame 121.

Figure 3:
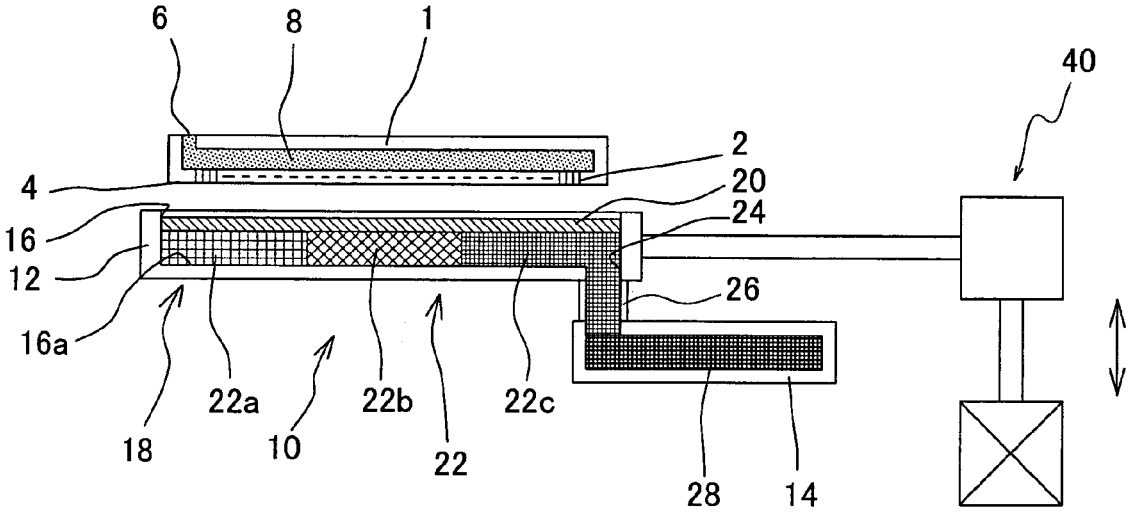
FIG. 3 is a schematic diagram of a recovery apparatus of a first embodiment of the present invention.

As shown in FIG. 3, a recording head 1 includes a nozzle surface 4 in which a plurality of nozzles 2 are opened. The recording head 1 discharges ink from the nozzles 2 by driving a piezoelectric element, an electric thermal converter, and the like. Ink is supplied from a not shown ink tank or the like through an ink supply port 6 to the recording head 1. The ink is then supplied through an ink passage 8 to the nozzles 2.

The recording head 1 in the first embodiment is a full-line type head in which the nozzles 2 are arranged in a line covering an entire width of a recording area of a not shown recording medium. The recording head 1, however, may be a serial type head which is reciprocable in a direction perpendicular to a conveyance direction of the recording medium to perform recording.

The recording medium may be a recording sheet, a resin sheet, a post card, an envelope, or an optical disk, such as a CD-R (Compact Disk-Recordable) or DVD-R (Digital Versatile Disk-Recordable). The recording medium also may be cloth of, for example, a T-shirt.

The ink supply port 6 in the first embodiment is disposed at one end of the line of the nozzles 2. The ink passage 8 in the first embodiment is formed along the line of the nozzles 2.

A recovery apparatus 10 is provided under the recording head 1. The recovery apparatus 10 includes a holder member 12 disposed facing the nozzle surface 4 of the recording head 1, and a collection container 14 disposed outside the holder member 12.

The holder member 12 includes a recessed portion 16 opened toward the nozzle surface 4. An absorber 18 is housed in the recessed portion 16. In the first embodiment, a size of an opening of the recessed portion 16 is slightly larger than a size of the nozzle surface 4.

In the first embodiment, an actuator 40 attached to the recovery apparatus 10 moves the holder member 12 relative to the nozzle surface 4, thereby to cause the absorber 18 to abut and be separated from the nozzle surface 4 (i.e., to move upward and downward). In a case of a serial type head, the recording head 1 may be movable upwardly and downwardly. Alternatively, the holder member 12 may be movable upwardly and downwardly.

In the first embodiment, the absorber 18 housed in the recessed portion 16 of the holder member 12 includes an abutment foam 20 and a suction foam 22. The abutment foam 20 is layered on the suction foam 22 so as to cover an entire area of the opening of the recessed portion 16.

Figure 4:
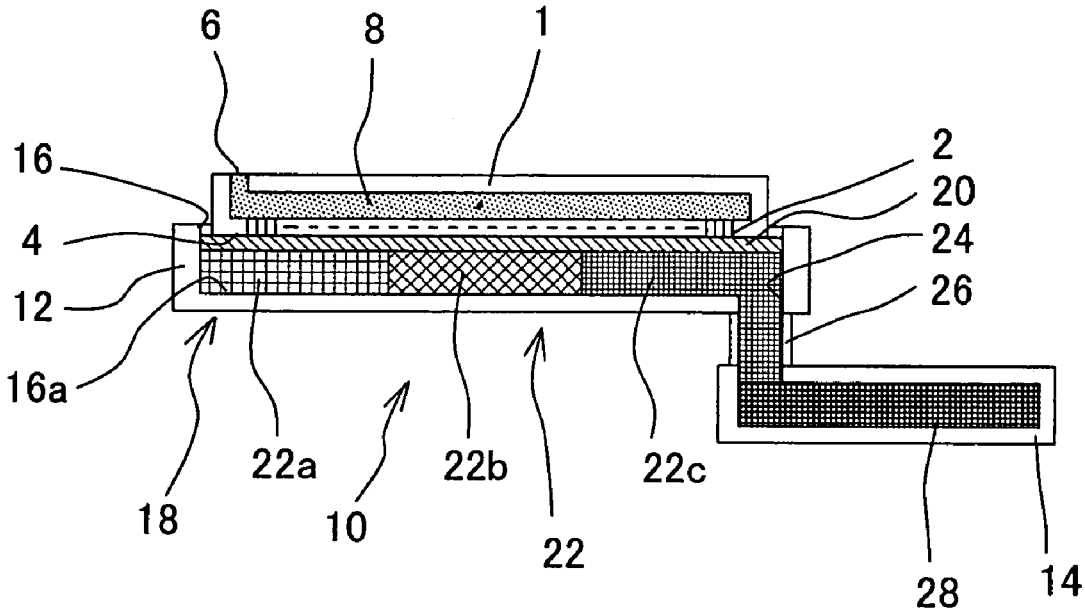
FIG. 4 is a schematic diagram of the recovery apparatus of the first embodiment in a state of absorbing ink.

As shown in FIG. 4, when the absorber 18 abuts the nozzle surface 4, the abutment foam 20 abuts an entire area of the nozzle surface 4.

The suction foam 22 is placed between the abutment foam 20 and a bottom surface 16*a* of the recessed portion 16 so as to cover an entire area of the bottom surface 16*a*. The suction foam 22 further includes a first suction foam 22*a*, a second suction foam 22*b* and a third suction foam 22*c* in the first embodiment.

A communication port 24 is opened downward in one end portion in the bottom surface 16*a* of the recessed portion 16 of the holder member 12 on a side of the collection container 14. One end of a communication tube 26 attached to an undersurface of the holder member 12 is connected to the communication port 24, while the other end of the communication tube 26 is connected to the collection container 14. Thus, an inside of the recessed portion 16 and an inside of the collection container 14 communicate with each other through the communication port 24 and the communication tube 26.

In the first embodiment, the communication port 24 is formed in a position facing the other end of the line of the nozzles 2 in the nozzle surface 4 of the recording head 1.

The first suction foam 22*a*, the second suction foam 22*b* and the third suction foam 22*c* are aligned side by side toward the communication port 24 (transversely in FIG. 4) between the abutment foam 20 and the bottom surface 16*a* of the recessed portion 16. The respective upper surfaces of the first suction foam 22*a*, the second suction foam 22*b* and the third suction foam 22*c* directly contact an undersurface of the abutment foam 20. One side surface of the first suction foam 22*a* and one side surface of the second suction foam 22*b* directly contact each other. Another side surface of the second suction foam 22*b* and one side surface of the third suction foam 22*c* directly contact each other.

The third suction foam 22*c* passes through the communication port 24 and the communication tube 26 and extends to reach the collection container 14. The third suction foam 22*c* directly contacts a waste liquid foam 28 which is housed in the collection container 14.

The abutment foam 20, the first suction foam 22*a*, the second suction foam 22*b*, the third suction foam 22*c* and the waste liquid foam 28 are made of polyurethane porous materials.

The abutment foam 20, the first suction foam 22*a*, the second suction foam 22*b*, the third suction foam 22*c* and the waste liquid foam 28 have different capillary forces, respectively. The abutment foam 20 has a smallest capillary force, while the waste liquid foam 28 has a largest capillary force.

Specifically, the first suction foam 22*a* has a capillary force greater than a capillary force of the abutment foam 20 but smaller than a capillary force of the second suction foam 22*b*. The third suction foam 22*c* has a capillary force greater than the capillary force of the second suction foam 22*b* but smaller than a capillary force of the waste liquid foam 28. The order of the capillary forces may be indicated as follows:

the abutment foam 20<the first suction foam 22*a*<the second suction foam 22*b*<the third suction foam 22*c*<the waste liquid foam 28

Indicating the values of these capillary forces by a height of vertical drawing, for example, the capillary force of the abutment foam 20 is 20 mm, the capillary force of the first suction foam 22*a* is 40 mm, the capillary force of the second suction foam 22*b* is 60 mm, the capillary force of the third suction foam 22*c* is 80 mm and the capillary force of the waste liquid foam 28 is 100 mm in the first embodiment.

The capillary force resulting from capillary phenomenon becomes smaller as a pore diameter becomes larger, while becoming greater as the pore diameter becomes smaller. The capillary force varies depending on differences in pore diameter of the porous materials.

In the first embodiment, the third suction foam 22*c* passes through the communication port 24 and the communication tube 26, and contacts the waste liquid foam 28. However, the waste liquid foam 28 may be configured to project upward, pass through the communication tube 26 and the communication port 24, and directly contact the third suction foam 22*c*. Alternatively, it may be possible to provide a connection foam having a capillary force greater than the capillary force of the third suction foam 22*c* and smaller than the capillary force of the waste liquid foam 28. In this case, one end of the connection foam may pass through the communication port 24 and the communication tube 26 and contact the third suction foam 22*c*, while the other end may contact the waste liquid foam 28.

A description will now be provided of an operation of the inkjet recording apparatus of the first embodiment.

First, the recording head 1 ejects ink droplets from the nozzles 2 by driving the piezoelectric element, the electric thermal converter, and the like, thereby to perform recording on a not shown recording medium.

Then, the holder member 12 is moved relative to the nozzle surface 4 at a predetermined recovery timing so as to cause the abutment foam 20 to abut the nozzle surface 4, as shown in FIG. 4. When the abutment foam 20 abuts the nozzle surface 4, suction is started due to the capillary force of the abutment foam 20, and thereby ink is suctioned from the nozzles 2 by the abutment foam 20.

The ink suctioned by the abutment foam 20 passes through the abutment foam 20 due to the capillary force of the abutment foam 20 and a self-weight of the ink. The ink then is suctioned by the first suction foam 22*a*, the second suction foam 22*b*, and the third suction foam 22*c*, respectively, due to the respective capillary forces greater than the capillary force of the abutment foam 20 and the self-weight of the ink.

The second suction foam 22*b* suctions the ink from the first suction foam 22*a* through the side surface thereof, which contacts the first suction foam 22*a*, into the second suction foam 22*b* due to the capillary force greater than the capillary force of the first suction foam 22*a*.

The third suction foam 22*c* suctions the ink from the second suction foam 22*b* through the side surface thereof, which contacts the second suction foam 22*b*, into the third suction foam 22*c* due to the capillary force greater than the capillary force of the second suction foam 22*b*.

That is, the ink is suctioned by the third suction foam 22*c* so as to flow from the first suction foam 22*a* toward the third suction foam 22*c*.

The ink suctioned by the third suction foam 22*c* passes through the communication port 24 and is suctioned by the waste liquid foam 28 since the waste liquid foam 28 has the capillary force greater than the capillary force of the third suction foam 22*c*. The ink is then collected as waste ink by the waste liquid foam 28 in the collection container 14. As described above, the communication port 24 is opened downward in the bottom surface 16*a* of the recessed portion 16. Accordingly, the ink in the third suction foam 22*c* passes through the communication port 24 also due to the self-weight of the ink and is absorbed by the waste liquid foam 28.

To terminate collection of the ink, the holder member 12 is moved relative to the nozzle surface 4 so as to separate the abutment foam 20 from the nozzle surface 4. This terminates the suction of the ink into the abutment foam 20, and thereby terminates collection of the waste ink into the waste liquid foam 28. According to the inkjet recording apparatus 120 in the first embodiment, as described above, the ink from the nozzles 2 may be collected efficiently in the waste liquid foam 28 without using a suction device or a pressure device, such as a pump and the like. Thus, a structure of the inkjet recording apparatus 120 may be simplified and downsizing of the inkjet recording apparatus 120 may be achieved.

As described above, the abutment foam 20 contacts the entire area of the nozzle surface 4. Thus, the ink may be suctioned equally from each of the nozzles 2 in the nozzle surface 4 by an equal capillary force. That is, the ink may be suctioned substantially evenly from the plurality of nozzles 2. Even in the recording head 1 of a full-line type with the nozzle surface 4 having a large area, the ink may be suctioned substantially equally from each of the nozzles 2 by an appropriate capillary force. Accordingly, it may be possible to prevent suction of more ink than is necessary thereby to reduce ink consumption.

As described above, the communication port 24 is located in the one end portion in the recessed portion 16, while the ink supply port 6 of the recording head 1 is located in a position facing the other end portion in the recessed portion 16. That is, the ink supply port 6 is located opposite to the communication port 24 and is distant from the third suction foam 22*c* having a greater capillary force. Accordingly, the ink may be suppressed from being suctioned quickly from only some of the nozzles 2 located close to the ink supply port 6, and may be suctioned substantially equally from each of the nozzles 2.

In the first embodiment, the suction foam 22 includes the first suction foam 22*a*, the second suction foam 22*b* and the third suction foam 22*c*. However, the suction foam 22 may not be limited to this configuration but may be, for example, integrally formed. In this case, the capillary force needs to become greater in an order of the abutment foam 20, the suction foam 22 and the waste liquid foam 28.

In the first embodiment, the absorber 18 includes the abutment foam 20 and the suction foam 22. However, the absorber 18 may not be limited to this configuration but may be, for example, integrally formed. In this case, the capillary force of the waste liquid foam 28 needs to be greater than the capillary force of the absorber 18.

Second Embodiment

Figure 5:
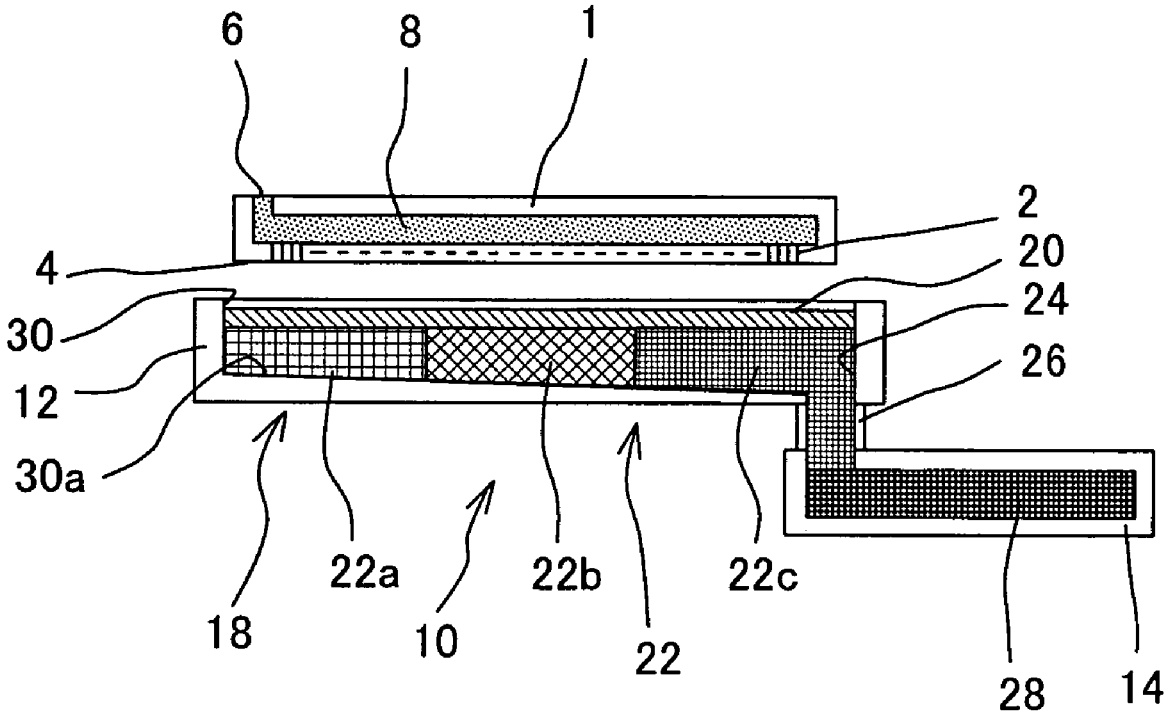
FIG. 5 is a schematic diagram of a recovery apparatus of a second embodiment.

A description will be provided with reference to FIG. 5 about a recovery apparatus of a second embodiment which is different from the first embodiment. Hereinafter (a third and a fourth embodiment included) the same members or components as in the first embodiment are given the same reference numerals, and detailed explanation thereof is omitted. An actuator for the recovery apparatus of the second embodiment (also the third and the fourth embodiment) is the same as the actuator 40 in the first embodiment, and the illustration thereof is omitted.

In the second embodiment, as shown in FIG. 5, only a recessed portion 30 of the holder member 12 has a different configuration from the recessed portion 16 in the first embodiment. Specifically, a bottom surface 30*a* of the recessed portion 30 slants downward toward the communication port 24.

That is, the ink is suctioned from the first suction foam 22*a* through the second suction foam 22*b* to the third suction foam 22*c* also due to the self-weight of the ink.

According to the configuration of the second embodiment as described above, it may be possible to guide the waste ink to the waste liquid foam 28 by means of the capillary force and the self-weight. Thus, collection of the waste ink may be more surely performed.

Third Embodiment

Figure 6:
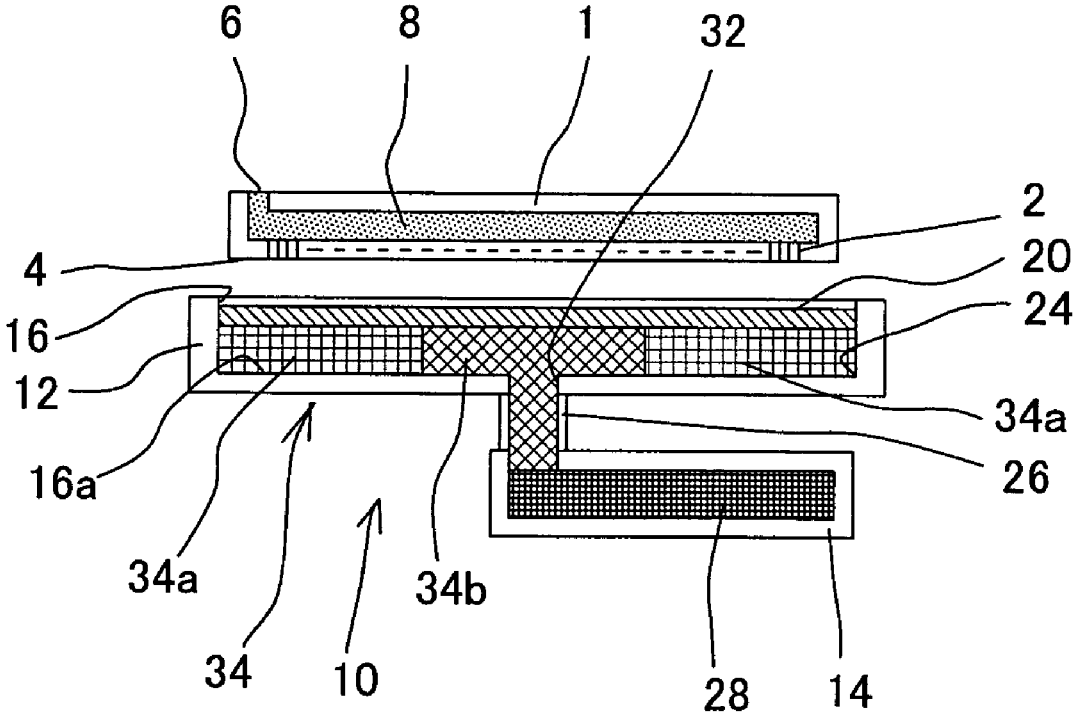
FIG. 6 is a schematic diagram of a recovery apparatus of a third embodiment.

In a third embodiment, as shown in FIG. 6, a communication port 32 is opened downward in an approximate center of the bottom surface 16*a* of the recessed portion 16. A suction foam 34 placed between the abutment foam 20 and the bottom surface 16*a* of the recessed portion 16 includes two first suction foams 34*a* and a second suction foam 34*b*. The first suction foams 34*a* are placed on both sides of the recessed portion 16. The second suction foam 34*b* is placed over the communication port 32 and between the two first suction foams 34*a*. Two side surfaces of the second suction foam 34*b* contact the respective two first suction foams 34*a*.

The second suction foam 34*b* is formed so as to pass through the communication port 32 and the communication tube 26, and directly contact the waste liquid foam 28. As described below, the first suction foam 34*a* has a capillary force greater than the capillary force of the abutment foam 20 but smaller than a capillary force of the second suction foam 34*b*. The second suction foam 34*b* has the capillary force smaller than the capillary force of the waste liquid foam 28. The order of the capillary forces may be indicated as follows:

the abutment foam 20<the two first suction foams 34*a*<the second suction foam 34*b*<the waste liquid foam 28

By contacting the abutment foam 20 with the nozzle surface 4, the ink is suctioned by the abutment foam 20. Then, the ink is suctioned from the abutment foam 20 by the two first suction foams 34*a* and the second suction foam 34*b*. Subsequently, the ink is suctioned from the two first suction foams 34*a* through the two side surfaces into the second suction foam 34*b*. Then, the ink is collected from the second suction foam 34*b* through the communication port 32 into the waste liquid foam 28 as waste ink.

Fourth Embodiment

Figure 7:
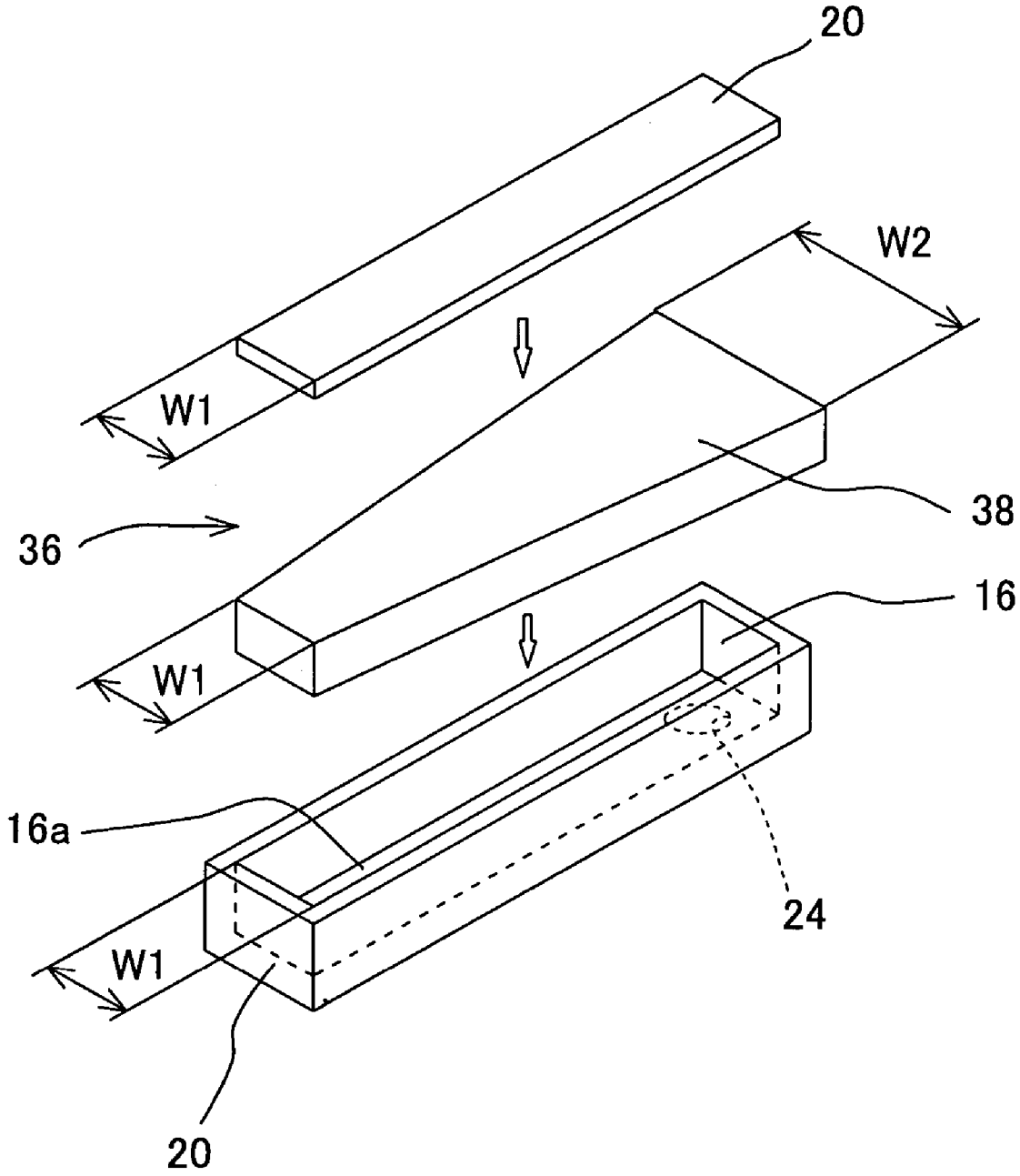
FIG. 7 is a schematic perspective view showing an absorber and a holder member of a recovery apparatus of a fourth embodiment.

As shown in FIG. 7, the recessed portion 16 of the holder member 12 has a substantially rectangular configuration with a width W1. An absorber 36 includes the abutment foam 20 and a suction foam 38.

The abutment foam 20 has a substantially rectangular configuration with a width the same as the width W1 of the recessed portion 16. One end of the suction foam 38 has a width the same as the width W1 of the recessed portion 16.

The other end of the suction foam 38 on a side of the communication port 24 has a width W2 larger than the width W1 of the one end. In other words, the suction foam 38 is formed so as to have a width linearly increasing from the one end to the other end. The abutment foam 20 and the suction foam 38 are made of polyurethane porous materials.

The suction foam 38 has a capillary force greater than the capillary force of the abutment foam 20 but smaller than a capillary force of a not shown waste liquid foam. When the suction foam 38 is housed in the recessed portion 16, the suction foam 38 is compressed such that a compression rate becomes larger from one end toward the other end of the suction foam 38 on the side of the communication port 24. When the suction foam 38 is compressed, a pore diameter is decreased, and thereby the capillary force is increased. Accordingly, the capillary force of the suction foam 38 housed in the recessed portion 16 continuously increases from the one end toward the other end of the suction foam 38 on the side of the communication port 24.

Accordingly, the suction foam 38 may be formed integrally. Since the capillary force of the suction foam 38 housed in the recessed portion 16 increases toward the other end of the suction foam 38 on the side of the communication port 24, the ink may be guided toward the communication port 24 without surface contact. Thus, the ink may be more surely guided to the waste liquid foam.

It is to be understood that the present invention should not be limited to the above described embodiments, but may be embodied in various forms without departing from the spirit and scope of the present invention.

What is claimed is:

1. A recovery apparatus comprising:

an absorber that directly abuts, at the same time, a plurality of nozzles of a recording head aligned in a line for discharging ink and absorbs the ink from the plurality of nozzles by a capillary force;

a holder member that includes an open recessed portion and a communication port communicating an inside of the recessed portion with an outside of the recessed portion, the recessed portion housing the absorber; and a waste liquid foam that is disposed outside the holder member and contacts the absorber through the communication port of the holder member;

wherein the waste liquid foam has a capillary force greater than the capillary force of the absorber;

wherein an ink supply port of the recording head is disposed at one end of the line of the nozzles, and the communication port of the holder member is disposed at a position different from a position facing the ink supply port;

wherein the absorber includes:

an abutment foam that directly abuts the plurality of nozzles; and a plurality of suction foams disposed in a direction along the line of the plurality of nozzles between the abutment foam and the communication port; and wherein the plurality of suction foams having respectively different capillary forces are aligned in such an order that the capillary forces of the respective suction foams become greater from the position facing the ink supply port toward the communication port.

2. The recovery apparatus according to claim 1;

wherein each of the plurality of suction foams has a capillary force greater than a capillary force of the abutment foam.

3. The recovery apparatus according to claim 1;

wherein the absorber abuts a nozzle surface of the recording head;

wherein the ink supply port supplies the ink to the respective nozzles along the line of the nozzles; and wherein the holder member includes the communication port formed in a position facing the other end of the line of the nozzles.

4. The recovery apparatus according to claim 1;

wherein the communication port is formed in a bottom surface of the recessed portion.

5. The recovery apparatus according to claim 4;

wherein the bottom surface of the recessed portion slants downward from a position lower than an upper end of the recessed portion toward the communication port.

6. An inkjet recording apparatus, comprising:

a recording head that includes a plurality of nozzles aligned in a line for discharging ink;

an absorber that directly abuts, at the same time, the plurality of nozzles and absorbs the ink from the plurality of nozzles by a capillary force;

a holder member that includes an open recessed portion and a communication port communicating an inside of the recessed portion with an outside of the recessed portion, the recessed portion housing the absorber; and a waste liquid foam that is disposed outside the holder member and contacts the absorber through the communication port of the holder member, wherein the waste liquid foam has a capillary force greater than the capillary force of the absorber;

wherein an ink supply port of the recording head is disposed at one end of the line of the nozzles, and the communication port of the holder member is disposed at a position different from a position facing the ink supply port;

wherein the absorber includes:

an abutment foam that directly abuts the plurality of nozzles; and a plurality of suction foams disposed in a direction along the line of the plurality of nozzles between the abutment foam and the communication port; and wherein the plurality of suction foams having respectively different capillary forces are aligned in such an order that the capillary forces of the respective suction foams become greater from the position facing the ink supply port toward the communication port.

7. The inkjet recording apparatus according to claim 6, further comprising:

an actuator that causes the absorber to abut the plurality of nozzles;

wherein the absorber is separated from the plurality of nozzles when the actuator is out of operation.

8. The inkjet recording apparatus according to claim 6;

wherein each of the plurality of suction foams has a capillary force greater than a capillary force of the abutment foam.

9. The inkjet recording apparatus according to claim 6;

wherein the recording head includes:

a nozzle surface provided with the plurality of nozzles aligned in the line;

wherein the ink supply port supplies the ink to the respective nozzles along the line of the plurality of nozzles; and wherein the holder member includes the communication port formed in a position facing the other end of the line of the plurality of nozzles.

10. The inkjet recording apparatus according to claim 6;

wherein the communication port is formed in a bottom surface of the recessed portion.

11. The inkjet recording apparatus according to claim 10;

wherein the bottom surface of the recessed portion slants downward from a position lower than an upper end of the recessed portion toward the communication port.

12. The recovery apparatus according to claim 1;

wherein the absorber directly abuts all of the plurality of nozzles.

13. The inkjet recording apparatus according to claim 6;

wherein the absorber directly abuts all of the plurality of nozzles.

14. The recovery apparatus according to claim 1;

wherein the holder member moves along a facing direction to the plurality of nozzles such that the absorber directly abuts the plurality of nozzles.

15. The inkjet recording apparatus according to claim 6;

wherein the holder member moves along a facing direction to the plurality of nozzles such that the absorber directly abuts the plurality of nozzles.

* * * * *